US012130076B2

(12) United States Patent
Bertschi

(10) Patent No.: US 12,130,076 B2
(45) Date of Patent: Oct. 29, 2024

(54) DRAWER DEVICE AND COVER WITH LIFTING MEANS

(71) Applicant: Julius Blum GmbH, Hoechst (AT)

(72) Inventor: Daniel Bertschi, Gelfingen (CH)

(73) Assignee: JULIUS BLUM GMBH, Hoechst (AT)

( * ) Notice: Subject to any disclaimer, the term of this patent is extended or adjusted under 35 U.S.C. 154(b) by 221 days.

(21) Appl. No.: 17/834,483

(22) Filed: Jun. 7, 2022

(65) Prior Publication Data

US 2022/0299260 A1 Sep. 22, 2022

Related U.S. Application Data

(63) Continuation of application No. PCT/EP2020/085074, filed on Dec. 8, 2020.

(30) Foreign Application Priority Data

Dec. 9, 2019 (CH) ..... 1570/19

(51) Int. Cl.
*F25D 25/00* (2006.01)
*F25D 25/02* (2006.01)

(52) U.S. Cl.
CPC ..... *F25D 25/025* (2013.01)

(58) Field of Classification Search
CPC ..... F25D 25/025; F25D 2317/0411; F25D 2317/043; A47B 2210/08; A47B 2210/06; A47B 2210/0091; A47B 77/16; A47B 88/919; A47B 88/969; A47B 88/994; A47B 88/457; A47B 88/0414; A47B 2088/001;

(Continued)

(56) References Cited

U.S. PATENT DOCUMENTS 5,157,940 A * 10/1992 Bertu ..... F25D 17/042 62/268
5,483,903 A 1/1996 Pierce et al.
(Continued)

FOREIGN PATENT DOCUMENTS

CH 716909 A2 * 6/2021 ..... A47B 77/16
CN 101912995 12/2010
(Continued)

OTHER PUBLICATIONS

International Search Report issued Mar. 1, 2021 in International (PCT) Application No. PCT/EP2020/085074.

*Primary Examiner* — Janet M Wilkens
(74) *Attorney, Agent, or Firm* — Wenderoth, Lind & Ponack, L.L.P.

(57) ABSTRACT

A drawer device includes a drawer body, a drawer movable linearly therein, and a cover movable relative to the drawer and relative to the drawer body in a lifting direction by a lifting element. A controlled relative movement of the cover can be carried out in the lifting direction by the lifting element and a controller to allow evacuation and/or dehumidification of the drawer interior. The lifting element is arranged to run along two lateral edges of the cover, and each lifting element has a motor, a spindle, and a linear carriage connected to the spindle and linearly movable. A profiled lifting section is operatively connected to a securing element on the drawer body, and can be moved by the lifting element in the lifting direction relative to the cover in a controlled manner by a controller.

13 Claims, 5 Drawing Sheets

(58) Field of Classification Search
CPC ..... A47B 2088/976; A47B 2088/205; B65D 81/2038
USPC ..... 32/309, 330.1; 62/382; 312/309, 330.1
See application file for complete search history.

(56) References Cited

U.S. PATENT DOCUMENTS

| | | | | |
|---|---|---|---|---|
| 7,185,959 | B2 | 3/2007 | Mueller et al. | |
| 8,941,271 | B2 | 1/2015 | Tsuri et al. | |
| 10,383,348 | B2 | 8/2019 | Bocks et al. | |
| 11,530,870 | B2 * | 12/2022 | Bertschi | A23L 3/36 |
| 11,805,900 | B2 * | 11/2023 | Bertschi | A47B 88/457 |
| 2004/0017139 | A1 | 1/2004 | Mueller et al. | |
| 2013/0181546 | A1 | 7/2013 | Tsuri et al. | |
| 2016/0324196 | A1 | 11/2016 | Bocks et al. | |
| 2020/0390239 | A1 * | 12/2020 | Wada | F25D 25/025 |
| 2021/0123667 | A1 | 4/2021 | Bertschi | |

FOREIGN PATENT DOCUMENTS

| | | | | |
|---|---|---|---|---|
| CN | 105605866 | | 5/2016 | |
| DE | 10 2014 015 788 | | 4/2016 | |
| DE | 20 2017 006 169 | | 2/2018 | |
| JP | 50-123528 | | 3/1949 | |
| JP | 3-170107 | | 7/1991 | |
| JP | 03213987 | A * | 9/1991 | |
| JP | 2003-24258 | | 1/2003 | |
| JP | 2003-299531 | | 10/2003 | |
| JP | 2004-275816 | | 10/2004 | |
| WO | 2019/141574 | | 7/2019 | |
| WO | WO-2021116043 | A1 * | 6/2021 | A47B 77/16 |
| WO | WO-2021116044 | A1 * | 6/2021 | A47B 77/16 |

* cited by examiner

DRAWER DEVICE AND COVER WITH LIFTING MEANS

BACKGROUND OF THE INVENTION

The present invention relates to a drawer device comprising a drawer body, a drawer which can be moved linearly therein, and a cover which can be moved relative to the drawer and relative to the drawer body in a lifting direction by a lifting element such that a controlled relative movement of the cover can be carried out in the lifting direction by the lifting element and a controller and such that the drawer interior can be evacuated and/or dehumidified after the cover is brought into the closed position. The invention further concerns a cover of a drawer device with a drawer in a drawer body, and an evacuation and/or a dehumidification of the drawer interior can be made possible when the cover is closed, and the lifting element is arranged on or in the cover.

Refrigerators for storing food have several drawbacks, because a large amount of electrical energy is continuously required in order to constantly and massively cool an interior space. Little attention has been paid to the inner climate of the refrigerator so far. According to an investigation of the Hygiene Council which performed an international study with the name Hygiene Report 2010, the refrigerator with approximately 11400000 germs per square centimeter is more contaminated than a toilet with approximately 100 pathogens per square centimeter. This information received widespread media coverage in 2010. However, apart from recommendations to more often clean the refrigerator, no noticeable improvements have been taken place up to now.

For the first time, DE202017006169 generally disclosed a drawer device with a drawer and a cover, in which a negative pressure could be produced within a drawer interior with the aid of a pump. The drawer device includes a drawer having walls and a drawer interior, the drawer being operatively connectable to a cover and being linearly movably supported within a drawer body. However, more details about the drawer, the cover and possible lifting means and evacuation means have been largely left open in the DE202017006169 reference.

The closest prior art is the WO2019/141574 reference to the applicant. Food which does not have to be necessarily cooled can be stored in a drawer device at room temperature, and an increased energy consumption for cooling can be dispensed.

The drawer interior can be evacuated with a slight underpressure, below the atmospheric pressure, which can be produced and held in a controlled manner. In this way, food can be longer edible or held palatable in a simpler manner. The storage within the drawer body with the drawer device requires less energy than the refrigerator, because the oxygen deprivation in the interior space is completed after a few minutes, and practically no further electricity is required thereafter. A drawer device can be provided without harmful materials such as cooling agents or thermal insulation. The consumption of plastic bags, with the known vacuuming with the aid of vacuum devices, can be significantly reduced, and yet food can be stored over longer periods of time without any problems. With drawer devices, food can be easier stored, environmentally friendlier and more energy efficiently. This has a positive effect on the quality of the food and on the health of the consumers. Also, less food would be discarded and the often criticized "food waste" can be restricted, because the quality of food can be longer maintained.

The drawer body forms the outer shell in which the cover and the drawer can be supported in a movably-protected manner. Lifting means configured to be driven electrically and by a controller and evacuating means are arranged in the cover or in the drawer, so that the evacuation can be made possible upon supporting the cover onto the drawer. By an air channel, air can be pumped out from the drawer interior. With the arrangement of sensors, the evacuation can be performed automatically and also the ventilation can be detected before opening the drawer, and can be automatically introduced by the controller.

The lifting means known so far from the WO2019/141574 reference fulfill their tasks well and the cover can be precisely lowered onto the drawer by means of a controller in a controlled manner, and can be again distanced from the drawer linearly in the lifting direction. The lifting means are electrically driven and controlled. In part, the closing performance leaves to be desired with the known solution, because the cover does not sufficiently seal against the outside.

However, there was also the desire to improve the energy consumption and the handling, so that the drawer device becomes more accepted to customers.

SUMMARY OF THE INVENTION

The present invention has the object to improve a drawer device for evacuating and/or for dehumidification of the drawer interior and to improve a cover such that the usability is increased upon closing, that the energy consumption can be reduced and a secured, reproducible movement of the cover in the lifting direction and a sealed support of the cover on the drawer can be provided.

With evacuation, a slight underpressure below the atmospheric pressure of 150 mbar and more are to be understood here, thus absolute pressures of less than 850 mbar which can be produced in the drawer interior or within the interior space of containers arranged within the drawer.

BRIEF DESCRIPTION OF THE DRAWINGS

Preferred embodiments of the subject matter according to the invention will be explained in the following in connection with the accompanying drawings, in which:

FIG. 4*a* shows a side view of the cover and a portion of the drawer with the cover in the open position, thus lifting element in the open position, whereas

DETAILED DESCRIPTION OF THE INVENTION

Figure 1:
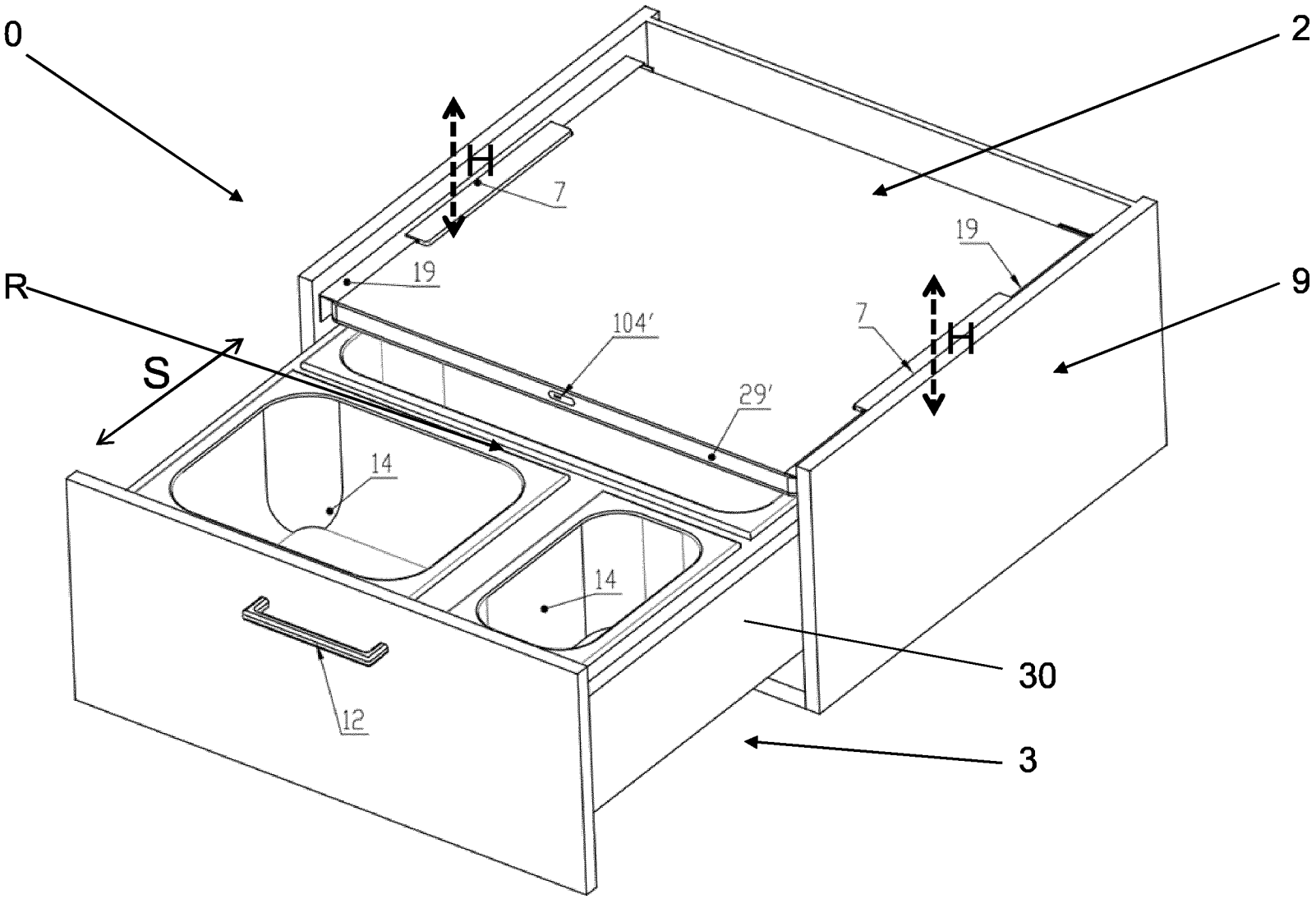
FIG. 1 shows a perspective view of a drawer device in a drawer body with the drawer open.

The drawer device 0 is denoted with 0 in an entirety and includes a drawer 3 with a drawer interior R and a cover 2 movable relative in a lifting direction H by lifting element 7.

The drawer 3 includes walls 30 and the drawer interior R and is movably supported between a closed position and an open position in the sliding movement direction S, and is configured to be evacuated and/or dehumidified.

The drawer 3 can be operatively connected to the cover 2 and is movably supported linearly within the drawer body 9 in a sliding movement direction S. The drawer body 9 forms the outer shell in which the cover 2 and the drawer 3 are movably supported in a protected manner. The drawer 3 is linearly movably supported in a drawer slide, not further explained in detail here, so that the drawer 3 can be brought into an open position and a closed position. In FIG. 1, the open position of the drawer 3 is shown.

The drawer interior R configured to be evacuated and/or dehumidified is formed by a plurality of containers 14. The containers 14 are arranged within the drawer 3 and each of the containers 14 has a same height, but different sizes. Jointly with the drawer interior R, the inner spaces of the containers 14 can also be evacuated. Preferably, the containers 14 are configured as Gastronorm containers, and the inner spaces of which can form the entire drawer interior R which can be closed by the cover 2 and can be configured to be evacuated and/or dehumidified. The containers 14 are supported in the drawer 3 and can be entrained with the drawer 3, but can also be removed. However, the containers 14 can also have other forms and sizes.

For evacuating the drawer interior R, the cover 2 movably arranged within the drawer body 9 serves therefore. The cover 2 is configured to be airtight and is supported so as to be lowered onto the drawer 3 in a lifting direction H extending perpendicular to the sliding movement direction S. Here, the cover 2 is fixed to the drawer body 9 via a fastening element, so that a relative movement between the cover 2 and the drawer 3 can be provided. A mounting bracket 19 is chosen for the fastening element here. However, a limb or the like arranged on the drawer body 9 may also be used for the fastening element.

Lifting element 7 is arranged on and/or partially in the cover 2, within the drawer body 9, the lifting element 7 movably holding the cover 2 within the drawer body 9 in the lifting direction H. The lifting element 7 can be actuated by a not shown controller to which an operating button 104', as in the present case, and a closed position sensor 29' can be connected. Only when the closed position sensor 29' signalizes that the drawer 3 is in the closed position below the cover 2 which is fixed in the sliding movement direction S, the lifting element 7 is activated so as to lower the cover 2 onto the drawer 3.

With the lifting element 7, the cover 2 can be lifted from the drawer 3 and the containers 14, respectively, in a controlled manner and can be again lowered thereon. Of course, the lifting element 7 is electrically driven and can be controlled by the controller. In this way, the lifting movement of the cover 2 in the lifting direction H perpendicular to the sliding movement direction S can be provided. The containers 14 within the drawer 3 of the drawer device 0 can be closed in an entirety to the above with respect to conventional drawers, namely in that the operator manually closes the drawer 3 and the cover 2 is lowered onto the containers 14 in the closed position of the drawer 3, and seals the containers 14 from above in an airtight manner.

Figure 2:
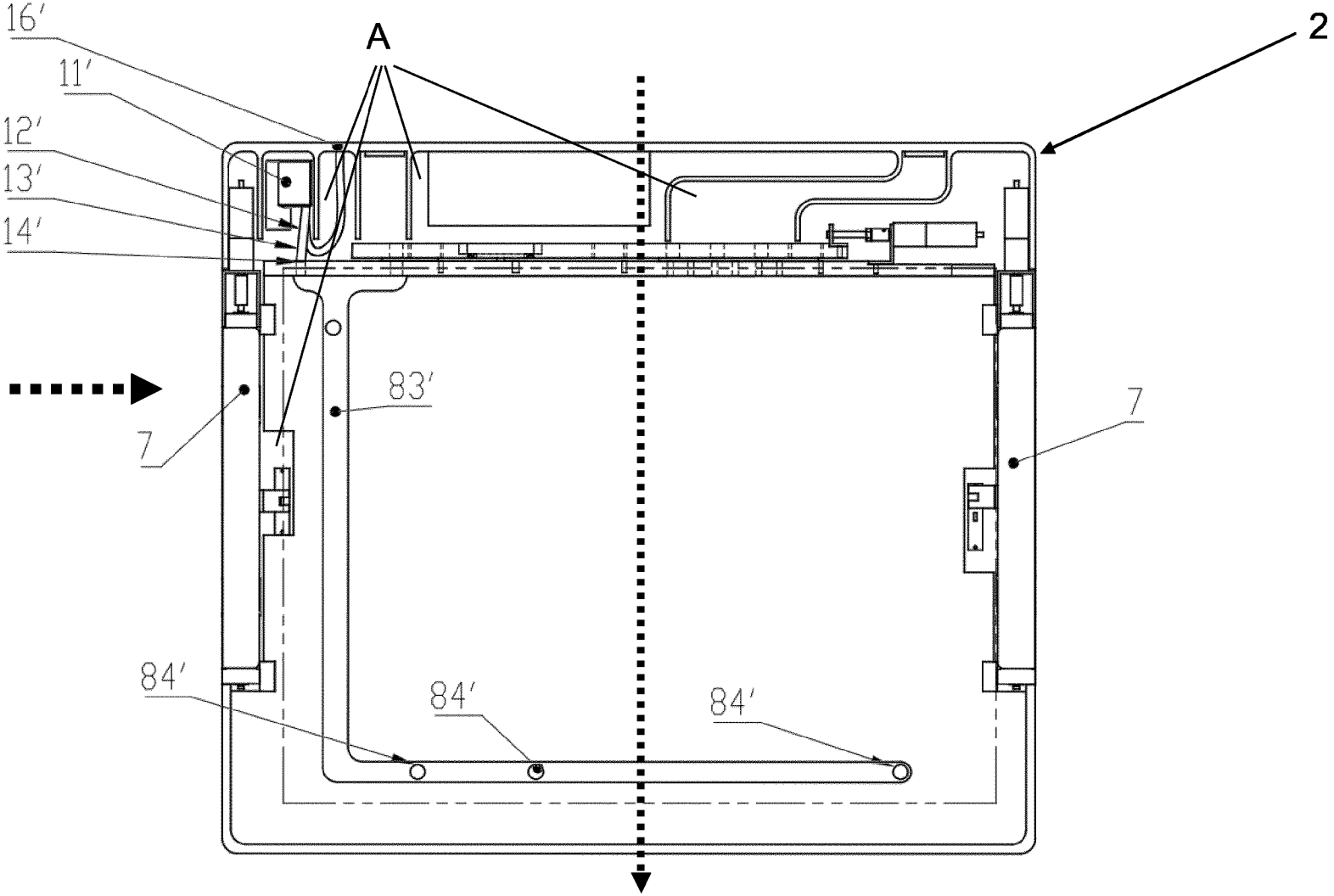
FIG. 2 shows a top view onto the drawer with the top layer removed, in which the components partially integrated in the cover can be seen.

In FIG. 2, the cover 2 configured to be airtight is shown. It can be particularly preferred that the cover 2 includes several layers. In order to obtain a compact construction of the cover 2, as many electronical components, channels and/or tubes and cables are integrated into the cover 2.

In a plurality of recesses A in the cover 2, evacuating element, a controller and further electrical components are shown here. A possible dehumidification element is omitted for the sake of simplicity, because especially the lifting element 7 are of interest.

As the evacuating element, a pump 11', an air tube 12' to the pump 11' and a connection 14' are arranged here. In addition, a check valve 13' is advantageous so that the evacuated volume is not vented in an undesired manner. These components 11', 12', 13', 14' are arranged on the later front panel 17 and, respectively, on the side of the cover 2 facing away from the operating button 104'.

The evacuation of the drawer interior R and of the containers 14 can be provided by the pump 11' via evacuating channels 83' and holes 84' extending in the cover 2. By a controllable valve, an evacuation of the drawer interior R and of the containers 14 can be automatically performed, namely in that the at least one evacuation channel 83' is opened or closed by a valve. As soon as the valve is open, the air can be evacuated by the pump 11'. For the evacuation, the air pressure and the level of underpressure in the drawer interior R or in the containers 14 shall be signalized to the controller. For this purpose, at least one pressure sensor is arranged in an evacuation channel 83'. In this way, the controller can be programmed to a threshold value of the underpressure, and in case that the pressure sensor reports a shortfall, the controller can activate the pump 11' correspondingly.

A possible dehumidifying element can be arranged in a similar manner within the cover 2 and can be operated via the controller.

Here, the lifting element 7 is configured in the form of a special lifting mechanism, and the components of which can be electromechanically controlled by the controller. The lifting element 7 is at least partially integrated in the lateral edges of the cover 2 and co-operate with the drawer body 9 in order to allow a relative displacement of the cover 2 to the drawer 3. Here, lifting element 7 comprises a pair of lifting elements each arranged in an integrated manner on a respective one of both lateral edges of the cover 2. However, an arrangement on only one side is also possible.

Figure 3A:
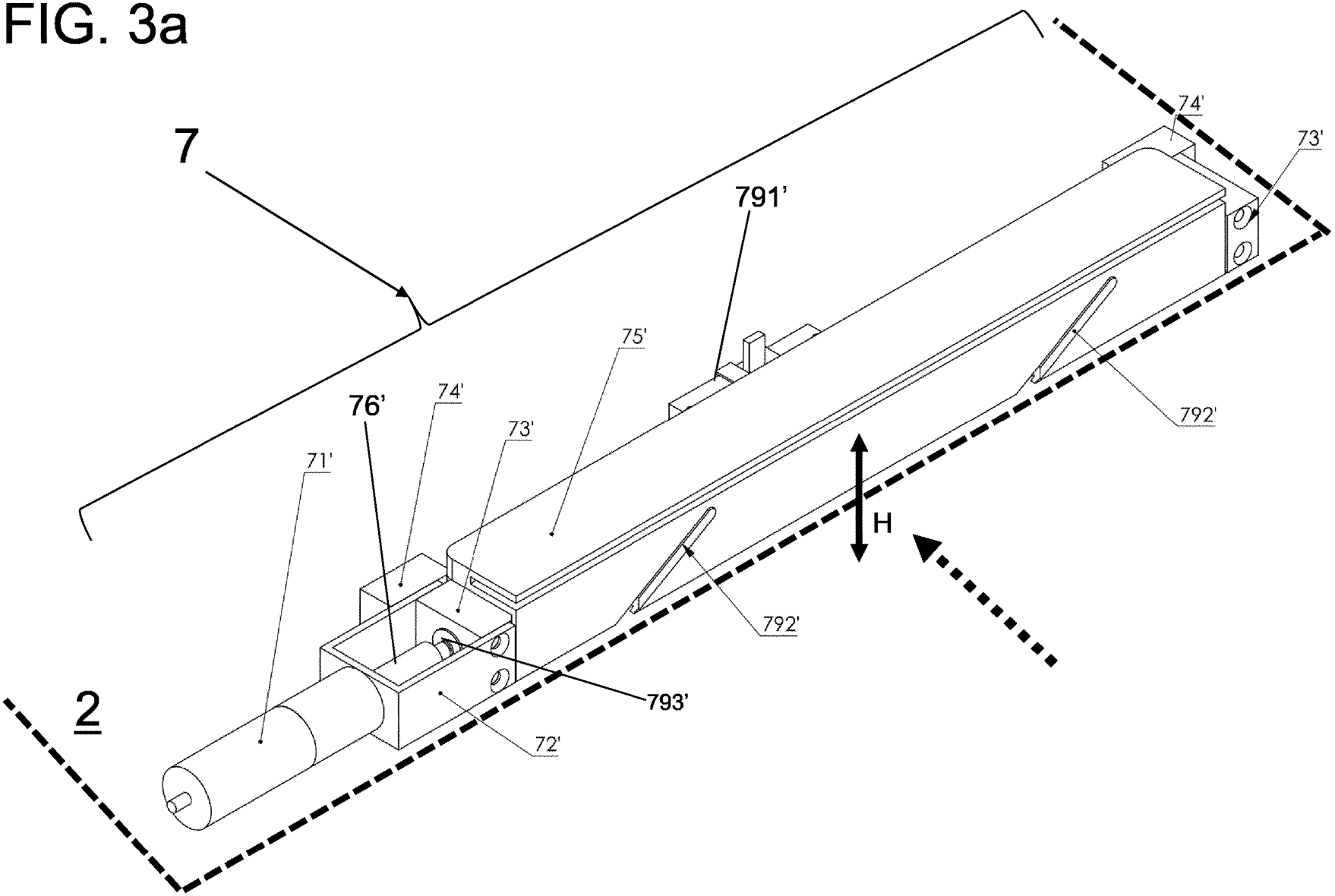
FIG. 3*a* shows a perspective side view of the cover with the lifting element in a perspective view.
Figure 3B:
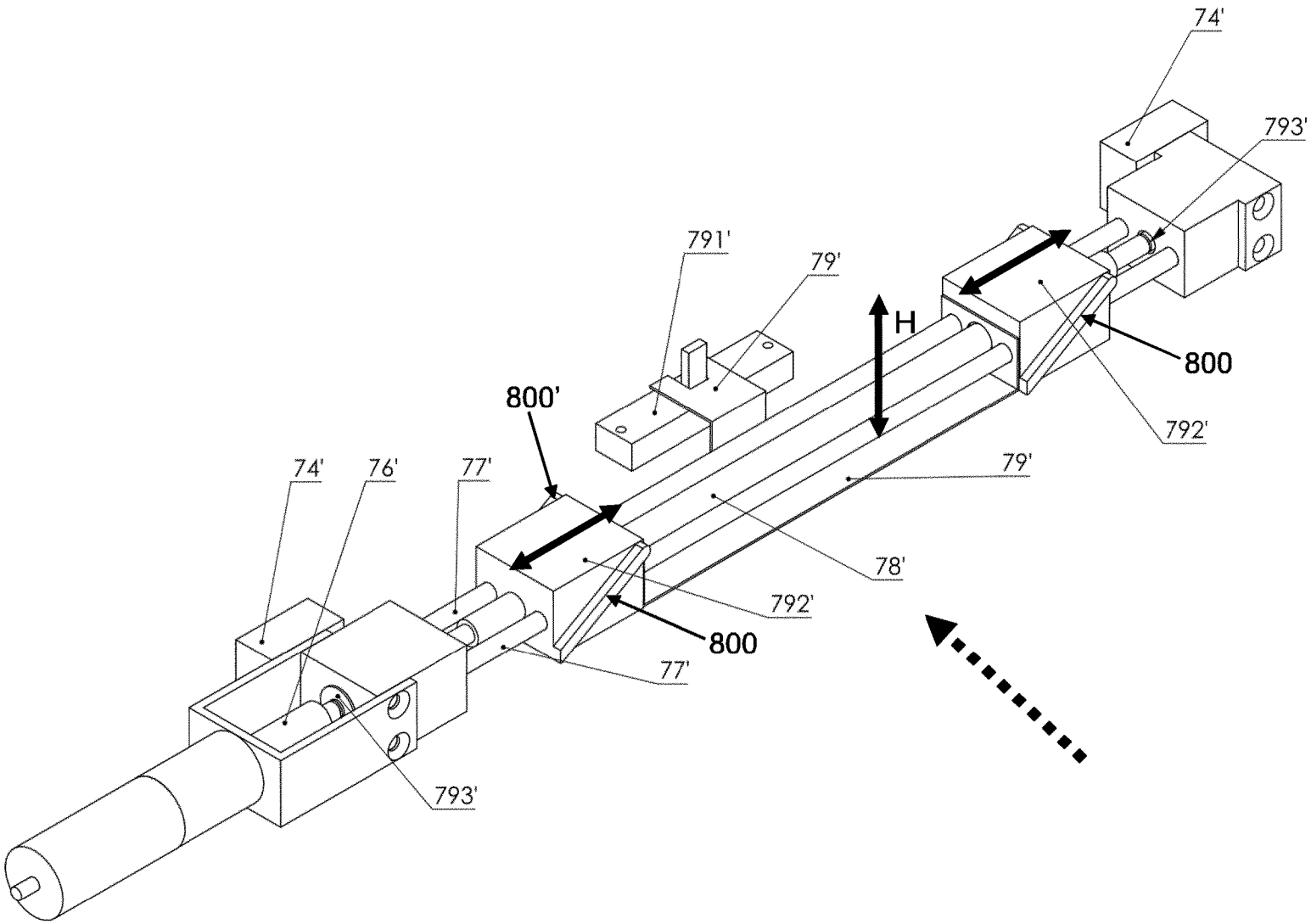
FIG. 3*b* shows a perspective view of only a part of the lifting element.

In FIG. 3*a*, the lifting element 7 are shown, the lifting element 7 co-operating with a mounting bracket 19 (not shown) in the form as a fastening element of the drawer body 9. A motor 71', preferably a geared motor 71', drives at least one, preferably two linear carriages 792' (FIG. 3*b*). The motor 71' is fixed to the cover 2 via an engine bracket 72'. The lifting element 7 has on both sides an end block 73' and a mounting block 74'. The motor 71' transmits its performance via a shaft coupling 76'. The shaft coupling 76' transmits force indirectly to both linear carriages 792' via a bearing bush 793' when the motor 71' is stationary or fixed in place relative to the cover 2 or to a surface of the cover 2.

A lifting profile 75' is mounted between the end blocks 73' and the mounting blocks 74', the lifting profile 75' being movable by the linear carriages 792' und thus indirectly by the motor 71' in the lifting direction H. The lifting profile 75' can be moved relative to the other components of the lifting element 7.

Here, the lifting profile 75' is fixed to the mounting bracket 19 of the drawer body 9, so that the cover 2, jointly with the remaining lifting element 7, is movable in a direction of the drawer 3 and in the opposite direction when the lifting profile 75' is held on the fastening element.

The motor 71' can be actuated by being connected to the controller, and the respective position of the linear carriages 792' can be read out by a slide potentiometer 791', likewise automatically by the controller. As a result, the relative position of the cover 2 can be exactly determined and is known at all times.

Here, the lifting profile 75' includes a longitudinal slot in which the fastening element, in particular in form of the mounting bracket 19, can be introduced. Therefore, a simple attachment of the cover 2 and of the lifting element 7 on the drawer body 9 can be provided. Between the fastening element and the lifting profile 75', a simple but a secure from-locking connection can be provided therewith.

In FIG. 3*b*, for a better understanding, the lifting profile 75', the drawer body 9 and the cover 2 are omitted. A plurality of guides 77' can be seen on which the two linear guides 792' run. A guide 79' of the slide potentiometer 791' is also required in order to detect a position of the at least one linear carriage 792'.

A spindle 78' extends transversely to the entire construction of the lifting element 7 between two end blocks 73' and between the motor 71' and an end block 73', respectively. The linear carriages 792' are operatively connected to the spindle 78', so that by a movement of the motor shaft of the at least one motor 71', the spindle 78' applies a force to the at least one linear carriage 792', the linear carriage 792' moving the lifting profile 75' and the remaining lifting means 7, respectively, in the lifting direction H.

A possibility for coupling the at least one linear carriage 792' to the lifting profile 75' is the provision of slits in the side surfaces of the lifting profile 75' and the provision of engagement limbs 800 on at least one side surface of each linear carriage 792'. Particularly preferable is the configuration of engagement limbs 800 and two opposing side surfaces of each linear carriage 792'. These engagement limbs 800 protrude away in a direction extending transversely to the movement of the linear carriages 792' and the spindle 78', respectively. It is preferable that the engagement limbs 800 are formed on the linear carriages 792'. Upon a linear displacement of the at least one linear carriage 792', the engagement limbs 800 displace the lifting profile 75' in a direction away from the spindle 78' in the lifting direction H, or move the lifting profile 75' closer to the spindle 78'. The spindle 78' and other components of the lifting element 7' do not vary their distance to a top surface of the cover 2.

The angles of the extending directions of the at least one slit on the lifting profile 75' and of the at least one engagement limb 800 on at least one linear carriage 792' relative to a longitudinal axis of the lifting element 7 shall be between 20° and 60°. The angles shall be chosen compatible to one another in an analogous manner.

In an open position of the cover 2, the lifting element 7, jointly with the cover 2, are spaced from the drawer 3. The cover 2 with the lifting element 7 is arranged on a height of the fastening element, here of the mounting bracket 19, of the drawer body 9. The engagement limbs 800 are arranged in the respective slits in the lifting profile 75' and are maximally introduced.

Figure 4A:
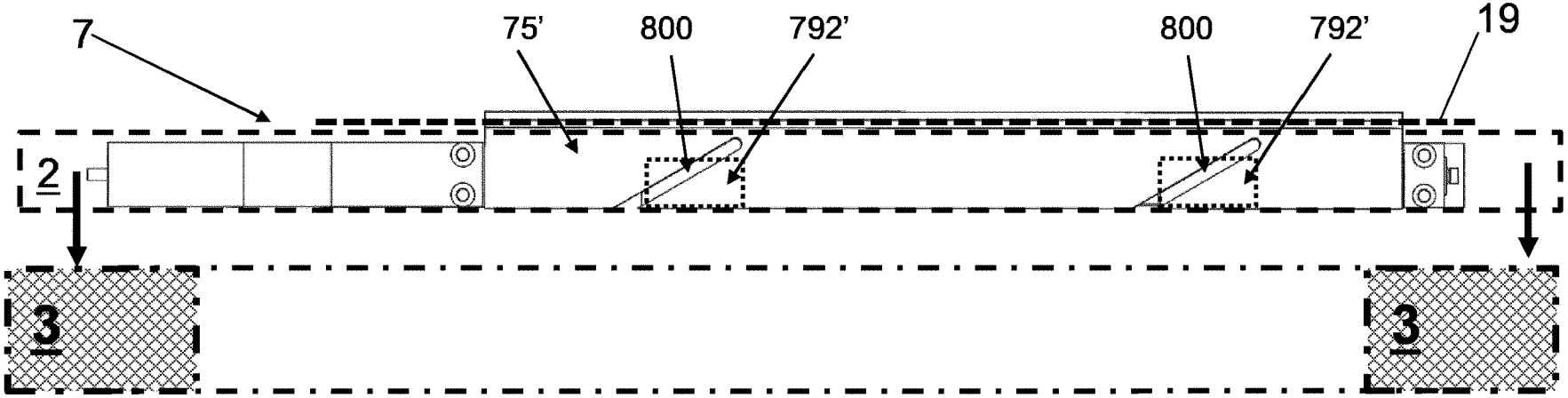
Figure 4B:
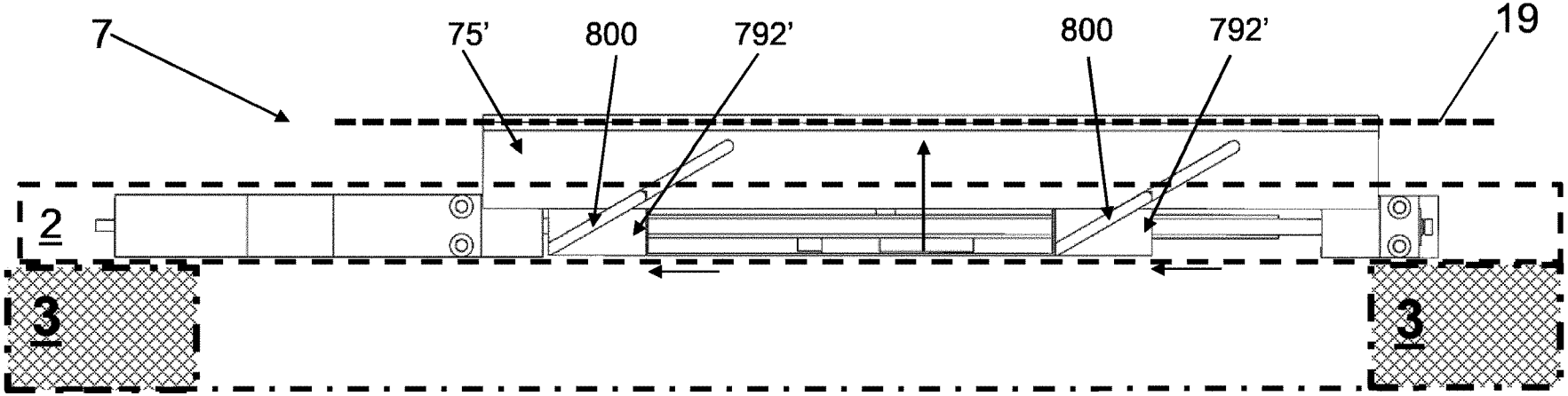
FIG. 4*b* shows a side view of the cover in the closed position, in which the cover covers the drawer interior, and the lifting element co-operates with a mounting bracket on the drawer body.

When the at least one linear carriage 792' is deflected, according to FIG. 4*b*, the lifting profile 75' with the mounting bracket 19 remains indirectly connected to the drawer body 9. The cover 2, jointly with the remaining components of the lifting element 7 and other components fixed to the cover 2, is lowered onto the drawer 3. This is the closed position of the cover 2. The motor 71' moves the at least one linear carriage 792', jointly with the engagement limbs 800, relative to the lifting profile 75'. The angled extension of the slits and of the engagement limbs 800 can be well seen. Depending on the steepness, the closing speed and the manual effort can be varied. By reading out the slide potentiometer 791', the controller knows when the motor 71' can be switched off.

In this position, the cover 2 rests on the drawer 3 and an airtight evacuation and/or dehumidification and/or a mere secured storage can be provided.

Besides a dehumidification element which can be arranged within the cover 2, optionally an illumination of the drawer interior R or of the container interior space 14 can be provided with blue visible light. As a result, besides the prevention of a moisture layer on the food, the mould formation can be restricted by radiation. The illumination element in question is arranged so as to radiate in a direction towards the drawer interior R and are controlled by the controller. Thereby, visible light with wavelengths between 420 and 460 nanometers shall be irradiated. In the simplest case, this happens permanently, independently from the opening condition of the cover 2 and of the drawer 3.

In order to provide a cover 2 as compact as possible, all components as far as possible shall be supported within the cover 2, so that such a cover 2 can be easily combined with already existing drawers 3. As a result, drawer devices 0 consisting of one existing drawer body 9, a drawer 3 and a cover 2 can be produced.

Preferably, the cover 2 has a sandwich construction, in which different materials are assembled in different layers to a cover 2. The cover 2 includes two outer airtight top layers and a core layer. Here, an additional printed circuit board is arranged which can also be used instead of one of the outer airtight top layer.

The layers are bonded statically operative to one another to a multi-layered cover 2, the cover 2 being torsion-resistant with a corresponding level of stiffness. The upper top layer is airtight and can consist of MDF, CFK or glass. However, an airtight plastic coating on a breathable material can be arranged as an upper top layer so as to obtain the airtightness of the upper top layer.

In the core layer, recesses A can be provided. Electrical devices, such as an evacuating element and a dehumidification element are arranged in the recesses A. The core layer can be produced by a plastic hard foam or of a comb-like plastic structure or a layer of solid plastic, and the required recesses A must be arranged. Channels and recesses A can be recessed from the material of the core layer.

On the printed circuit board, conductor tracks are arranged on at least one side, and the electrical consumers are connected to the conductor tracks. The contact of the electrical components and of the components to be controlled by the controller and of the controller on the printed circuit board is simple and uncomplicated. The printed circuit board forms part of the sandwich-like cover 2 and is preferably assembled in orientation such that the conductor tracks face in a direction of the drawer interior R. There is no disturbing cabling within the cover 2 continuing in the drawer body 9 outside the cover 2. The production of the cover 2 is simplified and the error rate upon the lifting movement of the cover 2 can be minimized.

In order to further increase the stability properties of the cover 2, a lower top layer with the same properties as the upper top layer as a part of the sandwich construction can be used. The lower top layer 22" is fixed to the printed circuit board on a side facing towards the drawer interior space. In order for the air to stream through the sandwich-like cover 2, holes must be arranged in the printed circuit board and in the optional top layer so as to evacuate the drawer interior R and the interior space of the containers 14, respectively.

For increasing the evacuation properties and the sealing properties of the cover 2, a layer of sealing profiles is arranged on a side facing towards the drawer interior space. As a result, the sealing against the edges of the containers 14 can be improved. For hygienical reasons, the sealing profiles are releasably fixed and are thus configured to be removed for cleaning purposes.

In a further embodiment with or without a lower top layer and/or sealing profiles, a sealing bracket and a layer of air filtering fleece can be arranged on a drawer-sided surface of the cover 2.

The invention claimed is:

1. A drawer device comprising a drawer body, a lifting element, a drawer movable linearly in the drawer body, a cover configured to be moved relative to the drawer and relative to the drawer body in a lifting direction by the lifting element to allow a controlled relative movement of the cover to be carried out in the lifting direction by the lifting element and a controller, and to allow the drawer interior to be evacuated and/or dehumidified after the cover is brought into a closed position, and a lifting profile operatively connected to a fastening element on the drawer body, wherein the lifting element is arranged to run along two lateral edges of the cover, the lifting element including:

a motor, a spindle, and a linear carriage connected to the spindle to thereby be movable linearly, in a fixed manner to the cover, wherein the lifting profile is configured to be moved by the lifting element in the lifting direction relative to the cover in a controlled manner by the controller relative to a remainder of the lifting element and the cover, to thereby lower the cover onto the drawer and distance the cover from the drawer.

2. The drawer device according to claim 1, wherein a slit is arranged in at least one side surface of the lifting profile, the slit being operatively connected to an engagement limb on a side surface of the linear carriage.

3. The drawer device according to claim 2, wherein an angle of the extending direction of the slit on the lifting profile relative to a longitudinal axis of the lifting element and an angle of the engagement limb on the linear carriage relative to a longitudinal axis of the lifting element are between 20° and 60° and are chosen correspondingly identical.

4. The drawer device according to claim 1, wherein slits are recessed on both sides of the lifting profile on opposing side surfaces.

5. The drawer device according to claim 1, wherein two linear carriages are linearly displaceably supported on the spindle.

6. The drawer device according to claim 1, wherein the linear carriage is arranged on a plurality of guides, the guides extending parallel to the spindle.

7. The drawer device according to claim 1, wherein the spindle is fixed to the cover, the spindle extending through an entire construction of the lifting element between an end block and the motor or a shaft coupling.

8. The drawer device according to claim 1, further comprising a slide potentiometer fixed to the spindle via a guide and/or fixed to the guide so as to detect a position of the linear carriage.

9. The drawer device according to claim 1, wherein the lifting profile is operatively connected to a mounting bracket as the fastening element on the drawer body.

10. The drawer device according to claim 1, wherein the lifting profile has a longitudinal slit configured to receive the fastening element.

11. The drawer device according to claim 1, wherein the lifting element is one of a pair of lifting elements each arranged on a respective one of the two lateral edges of the cover.

12. A cover of a drawer device with a drawer in a drawer body, the cover being configured to allow an evacuation and/or dehumidification of a drawer interior when the cover is closed, and lifting element being arranged on or within the cover, the lifting element being arranged to run along two lateral edges of the cover in a fixed manner, the lifting element including a motor, a spindle, and a linear carriage fixed to the cover and movable linearly, and the lifting element being operatively connectable to a lifting profile on the drawer body.

13. The cover according to claim 12, wherein the lifting element is arranged in a recess in the cover.

* * * * *